US005591090A

United States Patent [19]

Kauffman, Jr.

[11] Patent Number: 5,591,090

[45] Date of Patent: Jan. 7, 1997

[54] GOLF TRAINING DEVICE

[76] Inventor: Dean Kauffman, Jr., 40 Haller Dr., Cedar Grove, N.J. 07009

[21] Appl. No.: 512,101

[22] Filed: Aug. 7, 1995

[51] Int. Cl.[6] ..... A63B 69/36

[52] U.S. Cl. ..... 473/271; 473/273

[58] Field of Search ..... 273/188 R; 473/266, 473/269, 270, 271, 272, 273, 277

[56] References Cited

U.S. PATENT DOCUMENTS

| | | | |
|---|---|---|---|
| 4,147,356 | 4/1979 | Brandell | 473/271 |
| 4,651,994 | 3/1987 | Lee | 473/271 |
| 4,758,001 | 7/1988 | Otting et al. | 273/188 R |
| 5,288,074 | 2/1994 | Scheurer | 273/188 R |
| 5,334,028 | 8/1994 | Melligan | 273/188 R X |

*Primary Examiner*—George J. Marlo

*Attorney, Agent, or Firm*—Thomas L. Adams, Esq.

[57] ABSTRACT

A training device for a golfer, comprising:

a platform for the golfer to stand on; and an upright having a footing mounted near an edge of said platform, said upright having an upper arm extending laterally a predetermined distance from said upright and a stationary upper rest mounted distally on said upper arm to over-hang said footing and provide foot clearance underneath said upper arm for said predetermined distance inwardly over said platform from said upright, and hip clearance to allow unrestricted hip rotation in either direction, said upper rest being sized and positioned to laterally engage a leg of said golfer, said upright having means for adjusting height for said upper rest from approximately below knee level to mid-thigh level for said golfer, so that a golfer standing with a leg engaging said rest will tend to avoid swaying during a golf swing.

11 Claims, 1 Drawing Sheet

GOLF TRAINING DEVICE

BACKGROUND OF THE INVENTION

1. Field of the Invention

The present invention relates to a training device for golfers, and in particular, to a device designed to prevent undesirable hip and body swaying during the swing of a golf club.

2. Description of Related Art

A correct golf swing requires meticulous attention to timing, coordination and the positioning of the body of the golfer. One difficulty in perfecting a golf swing is the tendency for the body of the golfer to sway during the back swing and swing.

U.S. Pat. No. 5,197,739 attempts to signal swaying with an upright wand. Excessive sway during the back swing will cause the hip of the golfer to touch and deflect this upright wand. A disadvantage with this device is the fact that only extreme swaying will be detected. With feet planted shoulder width apart and even with one foot planted next to the base of the upright wand, the golfer's hip will normally be spaced from the upright wand, except for the most extreme swaying.

Moreover, since this upright wand deflects, the golfer is never forced to stay in a correct position and may never experience the feel of a proper swing. In addition, this training device has a very small platform which keeps one foot at a different elevation than the other, which further detracts from feeling a proper swing.

U.S. Pat. No. 5,328,186 shows a horizontal, U-shaped frame supporting a relatively short, upright dowel. The golfer can sense unacceptable swaying when a leg touches the upright dowel. As before, the simple upright dowel will only produce a sensation for extreme swaying. Also, the golfer cannot stand on the U-shaped frame and therefore the upright dowel will deflect and lift the frame when the golfer leans against the dowel. Thus, this upright will still not prevent the golfer from swinging with excessive sway.

British complete specification 1,440,215 shows a pair of leg rests mounted on a tripod that guides rather complicated motions. This complicated structure is impractical as a training guide for preventing swaying.

U.S. Pat. No. 3,940,144 shows stretch cords that connect around a golfer's legs to improve the swing. This device, however, will not prevent swaying.

U.S. Pat. Nos. 5,224,709 and 5,362,060 show apparatus that are placed at the feet of the golfer but do not interact with the golfer's body.

Accordingly, there is a need for a simple device for training a golfer to avoid swaying, without experiencing the disadvantages of the prior art.

SUMMARY OF THE INVENTION

In accordance with the illustrative embodiments demonstrating features and advantages of the present invention, there is provided a training device for a golfer, including a platform, and an upright. The upright has a footing mounted on the platform. The upright also has an upper rest overhanging the footing to provide foot clearance underneath the upper rest. The upper rest is sized and positioned to laterally engage a leg of the golfer. Thus, a golfer standing with a leg engaging the rest will tend to avoid swaying during a golf swing.

By employing apparatus of the foregoing type, an improved golf training device is achieved. In a preferred embodiment the upright can have a L-shaped upper arm that overhangs the footing of the upright. Thus there is clearance below the upright arm, allowing the golfer's feet to spread below the upper arm. This clearance is helpful since a golfer's stance can be relatively wide. Therefore, the leg engaging the upper arm can be at a comfortable angle, slanting under the upper arm.

In a preferred embodiment, the upright can have an upper arm telescopically fitted inside a post. Being telescopically mounted, the elevation of the upper arm can be adjusted by sliding the arm inside the post. Bolts, pins or the like can be used to hold the upper arm in one of various selectable positions. Also, while the upright post and upper arm are normally mounted on the platform, they can be detached for easy storage.

BRIEF DESCRIPTION OF THE DRAWINGS

The above brief description, as well as other objects, features and advantages of the present invention will be more fully appreciated by reference to the following detailed description of presently preferred, but nonetheless illustrative embodiments, in accordance with the present invention, when taken in conjunction with accompanying drawings, wherein.

DETAILED DESCRIPTION OF THE PREFERRED EMBODIMENT

Figure 1:
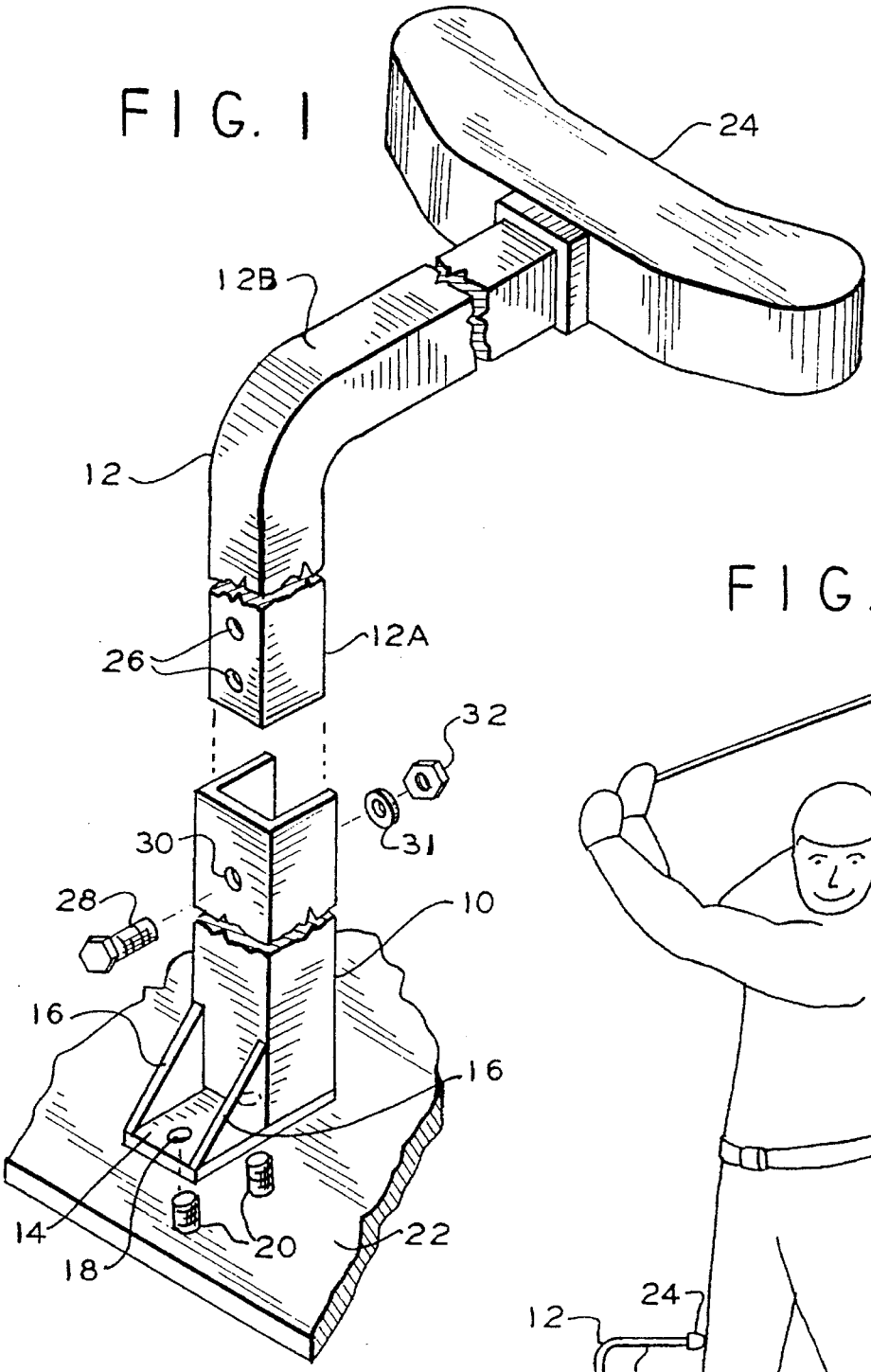
FIG. 1 is an axonometric view of a training device, with middle portions broken away for illustration purposes, in accordance with the principles of the present invention.

Referring to FIG. 1, a training device is shown as an upright having an upright post 10 and an upper arm 12. Post 10 is a C-shaped channel that is preferably 19.5 inches (49.5 cm) tall, although other heights can be used, depending upon the expected size of the golfer, the desired range of adjustment, etc.

The footing of post 10 is shown as a rectangular steel plate 14 welded to the bottom post 10. In some embodiments, plate 14 is eliminated and the footing end of upright post 10 is connected directly to platform 22. Plate 14 extends inwardly and is reinforced by vertical, triangular gusset plates 16.

Support plate 14 has a pair of holes 18 designed to receive threaded studs 20. Studs 20 are shown affixed to a steel platform 22. Platform 22 is preferably 4 feet (1.2 meters) long and 2 feet (0.6 meter) wide, although the platform can be dimensioned differently depending upon the space requirements, the size and expected stance of the golfer, etc.

Upper arm 12 is shown as a one inch (2.5 cm) square tube, bent at right angles to form an L-shaped upper arm. In some embodiments, the bend angle and the size of the tube can be altered depending upon the expected environment. In the preferred embodiment, the vertical branch 12A of arm 12 is 17 inches (43.2 cm) long while the horizontal, cantilevered branch 12B is 9.5 inches (24 cm) long.

The distal end of branch 12B of upper arm 12 is fitted with an upper rest 24 having a distal concave surface. In this embodiment, rest 24 has a shape similar to a shoulder rest for a crutch, although other shapes are contemplated. Instead of extending horizontally, in other embodiments the rest can be a taller, semi-cylindrical structure, or have a pillow-like shape. While the illustrated rest 24 is formed from a soft molded plastic, in other embodiments different materials can be used instead. Also, rest 24 can have an additional outer layer of padding made of such materials as foam, cloth, an elastomer, etc.

While upper arm 12 is shown spaced from post 10 in FIG. 1, branch 12A is designed to telescopically slide within upright post 10. To fix upper arm 12 at different selectable elevations, arm 12 has a plurality of selectable bolt holes 26. Each of the bolt holes 26 has an opposing mating hole (hidden in this view), both sized to allow a bolt to pass completely through branch 12A.

To hold arm 12 at the selectable elevations in post 10 a locking device is used. In this embodiment the locking device is in the form of a bolt 28 sized to pass through locking hole 30 in the web of post channel 10, and through one of the holes 26 in branch 12A. Thereafter bolt 28 can be secured in place with washer 31 and nut 32.

One of the holes 26 will be selected based upon the desired elevation of arm 12 and upper rest 24. Preferably, upper rest 24 of upper arm 12 will be elevated to engage leg L of the golfer (FIG. 3) just above the knee. The above-the-knee position provides good feedback on the amount of swaying by the golfer. A lower elevation will allow the golfer greater freedom of movement, but less feedback in response to swaying. Nevertheless, a golfer just beginning to use the illustrated training device may prefer the reduced sensitivity, only later raising arm 12 to increase sensitivity. The preferred adjustment range is from below the knee to mid-thigh, but may cover a different range depending upon the preferences of the golfer, the expected size of the golfer, the desired sensitivity, weight, structural rigidity, etc.

Figure 3:
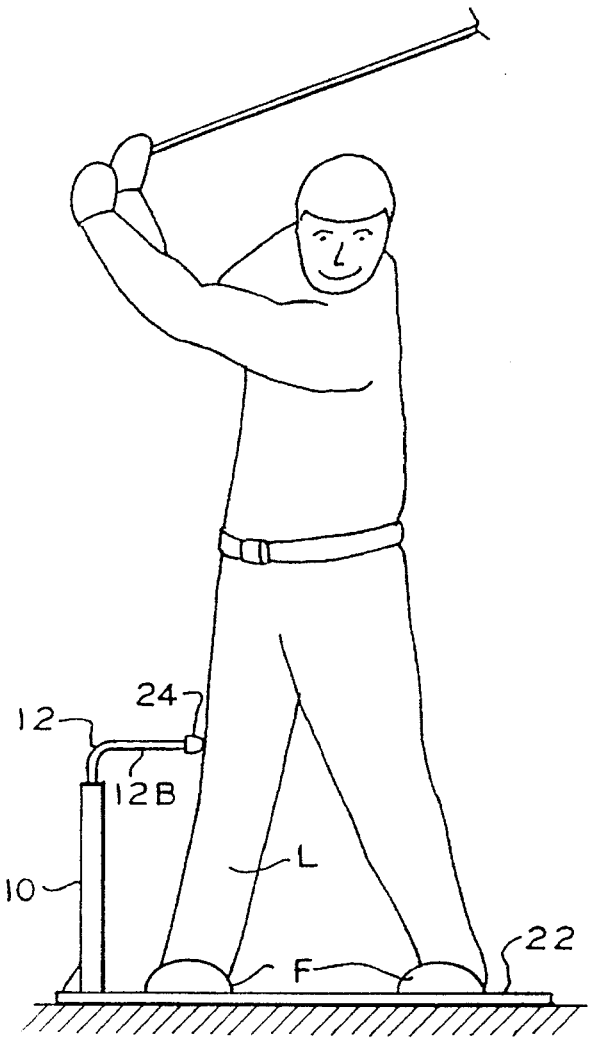
FIG. 3 is an elevational view of the training device of FIG. 2, being used by a golfer.
Figure 2:
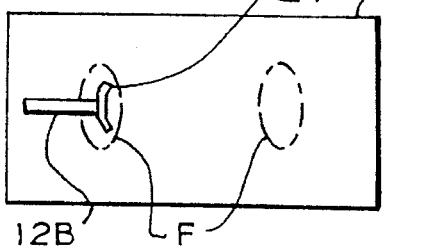
FIG. 2 is a plan view of the training device of FIG. 1, showing the entire platform.

In use, the golfer will stand as illustrated in FIGS. 2 and 3 with feet shoulder width apart (or at different spacings depending upon the club being used). The foot F closest to upper rest 24 will actually be planted below the rest. Accordingly, the cantilevered orientation of branch 12B allows significant foot clearance underneath arm 12. This allows a golfer to take a comfortable and correct stance during the swing.

As the golfer takes a back swing as illustrated in FIG. 3, back leg L will comfortably engage upper rest 24, above the knee. If the golfer starts to sway improperly, the golfer will notice leg L bearing heavily against rest 24. This unusual pressure clearly signals the outset of improper swaying. Significantly, the illustrated device will prevent the golfer from swaying any significant amount. Thus the golfer is forced to swing without swaying and will immediately experience the feeling of a proper swing without swaying.

When the golfer is done with the training device upright 10 will be detached from the threaded studs 20 to allow the device to lay flat for storage.

It is to be appreciated that various modifications may be implemented with respect to the above described, preferred embodiments. While the illustrated upright has a rectangular cross-section, in other embodiments the cross-section can be round, oval, polygonal or other shapes. Also the upright elements can be solid. Furthermore, while steel components are preferred, in other embodiments various metals, such as aluminium, wood, plastic or other materials can be used instead. While a panel-like platform is illustrated, in other embodiments the platform can be a different type of frame or can include means for fixing the upright to a floor or the ground, by staking or otherwise. Instead of an L-shaped upper arm, other embodiments may employ an upright that is tilted from vertical to allow clearance below the uppermost end of the upright. The angle chosen will depend upon the desired amount of clearance under the upright. Also, the means for setting the elevation for the upright can include threaded telescopic parts, spring loaded ball detents, blocks or shims of various heights that can be mounted at the footing of the upright, and the like.

Obviously, many modifications and variations of the present invention are possible in light of the above teachings. It is therefore to be understood that within the scope of the appended claims, the invention may be practiced otherwise than as specifically described.

I claim:

1. A training device for a golfer, comprising:

a platform for the golfer to stand on; and an upright having a footing mounted near an edge of said platform, said upright having an upper arm extending laterally a predetermined distance from said upright and a stationary upper rest mounted distally on said upper arm to over-hang said footing and provide (a) foot clearance underneath said upper arm for said predetermined distance inwardly over said platform from said upright, and (b) hip clearance to allow unrestricted hip rotation in either direction, said upper rest being sized and positioned to laterally engage a leg of said golfer, said upright having means for adjusting height for said upper rest from approximately below knee level to mid-thigh level for said golfer, so that a golfer standing with a leg engaging said rest will tend to avoid swaying during a golf swing.

2. A training device according to claim 1 wherein said upright is dimensioned to elevate said rest at least about knee high.

3. A training device according to claim 1 wherein said upright comprises a post supporting said upper arm.

4. A training device according to claim 3 wherein said upper arm is telescopically mounted in said post.

5. A training device according to claim 4 comprising:

a locking device for connecting between said post and said upper arm for holding said upper arm at a fixed elevation.

6. A training device according to claim 3 wherein said upper arm comprises a square tube, and wherein said post comprises a C-shaped channel.

7. A training device according to claim 3 wherein said upright comprises:

a support plate affixed under said post; and at least one gusset attached between said post and said support plate.

8. A training device according to claim 1 wherein said upper arm is L-shaped to cantilever over said platform.

9. A training device according to claim 1 wherein said upright is detachable from said platform for facilitating storage after use.

10. A training device according to claim 1 wherein said rest has a concave surface shaped to cradle a leg of the golfer.

11. A training device for a golfer, comprising:

a platform sized and arranged to allow the golfer to stand on the platform during a golf swing: and an upright including:

(a) a footing detachably mounted near an edge of said platform and having a support plate, and at least one gusset attached to said support plate, (b) a post mounted on said support plate and having a C-shaped channel, (c) an upper arm telescopically mounted in said post to extend laterally a predetermined distance from said upright and to be vertically adjustable on said post, said upper arm being L-shaped to cantilever over said platform, said upper arm comprising a square tube, (d) a locking device for connecting between said post and said upper arm for holding said upper arm at a fixed elevation, and (e) a stationary upper rest mounted distally on said upper arm to over-hang said footing and provide (a) foot clearance underneath said upper arm for said predetermined distance inwardly along said platform from said post, and (b) hip clearance to allow unrestricted hip rotation in either direction, said upper rest having a concave surface shaped to cradle a leg of the golfer and being sized and positioned to laterally engage a leg of said golfer, said upright having means for adjusting height for said upper rest from approximately below knee level to mid-thigh level for said golfer, so that a golfer standing with a leg engaging said rest will tend to avoid swaying during a golf swing.

* * * * *